US008213575B2

(12) United States Patent
Tamura et al.

(10) Patent No.: US 8,213,575 B2
(45) Date of Patent: Jul. 3, 2012

(54) X-RAY GENERATING APPARATUS

(75) Inventors: Tomomi Tamura, Kyoto (JP); Takumi Kobayashi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 183 days.

(21) Appl. No.: 12/513,364

(22) PCT Filed: Nov. 21, 2006

(86) PCT No.: PCT/JP2006/323228

§ 371 (c)(1), (2), (4) Date: May 3, 2009

(87) PCT Pub. No.: WO2008/062519

PCT Pub. Date: May 29, 2008

(65) Prior Publication Data

US 2010/0067664 A1 Mar. 18, 2010

(51) Int. Cl.
*H01J 35/06* (2006.01)

(52) U.S. Cl. ..... 378/136; 378/138

(58) Field of Classification Search ..... 378/137–138, 378/136, 119, 121

See application file for complete search history.

(56) References Cited

U.S. PATENT DOCUMENTS

| | | | | |
|---|---|---|---|---|
| 2003/0099327 | A1* | 5/2003 | Matsushita et al. | 378/138 |
| 2005/0058253 | A1* | 3/2005 | Inazuru et al. | 378/143 |

FOREIGN PATENT DOCUMENTS

| | | | |
|---|---|---|---|
| JP | 5-89810 | A | 4/1993 |
| JP | 2000-30641 | A | 1/2000 |
| JP | 2000-48746 | A | 2/2000 |
| JP | 2003-163098 | A | 6/2003 |
| JP | 2004-6295 | A | 1/2004 |

OTHER PUBLICATIONS

International Search Report for the Application No. PCT/JP2006/323228 mailed Jan. 9, 2007.

* cited by examiner

*Primary Examiner* — Hoon Song
(74) *Attorney, Agent, or Firm* — Cheng Law Group, PLLC

(57) ABSTRACT

According to the X-ray generating apparatus of this invention, a potential corresponding to that of a housing is applied to a first electrode, closest to a cathode, of at least two intermediate electrodes arranged between the cathode and a target. Therefore, even if the first electrode with an increased thermal capacity contacts the housing, the function of the X-ray generating apparatus will never be impaired. As a result, the first electrode is not easily restricted by structure, so that the first electrode may be enlarged as a measure for heat radiation, or that the first electrode may be placed in contact with the housing. The first electrode contacting the housing determines a positional relationship of the electron gun and housing to facilitate assembly of the X-ray generating apparatus. Further, all the potentials of the cathode, intermediate electrodes (e.g. a second electrode and a third electrode) and target will have straight polarity with respect to the potential of the first electrode, which facilitates power source control.

8 Claims, 8 Drawing Sheets

X-RAY GENERATING APPARATUS

TECHNICAL FIELD

This invention relates to X-ray generating apparatus for use in the industrial field, medical field and so on.

BACKGROUND ART

X-ray generating apparatus (X-ray tubes) are used in the industrial field, medical field and so on, and are used in nondestructive inspection system, for example. The X-ray tubes mounted in the nondestructive inspection system are divided broadly into a open type X-ray tube and a sealed type X-ray tube. The open type X-ray tube has a structure for vacuuming a housing using a turbo-molecular pump, for example, and enables changing of consumables such as a filament forming a cathode and a target. The sealed type X-ray tube does not require a vacuum pump, but has a vacuum-locked housing. Of the above types, the sealed X-ray tube includes an electron gun often having, mounted therein, a flat cathode similar to that used in a cathode-ray tube from the viewpoint of long-term stability.

FIG. 6 is a schematic view showing an electron beam extracting portion of a flat cathode. As shown in FIG. 6, two or more intermediate electrodes are arranged between a cathode 102*a* which emits an electron beam B, and a target. These intermediate electrodes are referred to as a first electrode 102*b* and a second electrode 102*c* in order from adjacent the cathode 102*a*. With the potential of the cathode 102*a* serving as reference potential, a negative potential is applied to the potential of the first electrode 102*b* and a positive potential to the second electrode 102*c*. The electron beam B emitted from the cathode 102*a* forms a crossover (virtual source) adjacent these electrodes (see sign "$D_S$" in FIG. 6).

A schematic view of a conventional X-ray tube with this electron gun mounted therein is shown in FIG. 7 or 8. As shown in FIG. 7 or 8, an X-ray tube T includes a vacuum housing 101 containing an electron gun 102 and a target 103, causes an electron beam B emitted from the electron gun 102 to collide with the target 103, and takes X rays generated from a position of collision out through an X-ray window 101*b* provided on the vacuum housing 101. The electron gun 102 has a cathode 102*a* which emits the electron beam B, and intermediate electrodes such as a first electrode 102*b* and a second electrode 102*c*. Since it is necessary to project the above crossover image with a desired focus diameter onto the target 103, an actual X-ray tube further includes a third electrode (also called a "focusing electrode") 102*d* as an intermediate electrode to form electron optics.

Because of the structure for assembling the X-ray tube T, the cathode 102*a* and first electrode 102*b*, and the first electrode 102*b* and second electrode 102*c*, of the electron gun 102 are mechanically interconnected, respectively. Since it is necessary to apply different potentials independently, the cathode and each electrode are assembled, for example, through an electric insulator such as alumina, sapphire or bead glass. As a method of applying potentials to the cathode and each electrode, as shown in FIG. 7 or 8, the potentials are applied from outside the X-ray tube T by electrically and mechanically connecting pins 105 of a stem 104 (see FIG. 7 or 8) and the objective electrodes through thin struts or ribbon electrodes 106 (see FIG. 8). Since a potential at a maximum of several kilovolts may be applied to these electrodes and cathode, the portion of electron gun 102 and the vacuum housing 101 are isolated by at least about 1 mm space gap. The vacuum housing 101 is grounded. As what specifies the potentials of these electrodes, a method has been proposed in which the above third electrode is placed in contact with the vacuum housing to have the same potential (see Patent Documents 1 and 2, for example).

Patent Document 1

Unexamined Patent Publication No. 2000-30641 (pages 2, 3, 5, FIG. 1)

Patent Document 2

Unexamined Patent Publication No. 2000-48746 (pages 2, 3, 5, FIG. 1)

DISCLOSURE OF THE INVENTION

Problem to be Solved by the Invention

With nondestructive inspection system having the X-ray tube T mounted therein, as shown in FIG. 7 or 8, a sample S is placed close to the X-ray window 101*b* for enlarged projection to conduct an inspection with increased precision. In order to secure an increased enlargement ratio for enlarged projection, it is necessary to minimize a distance (see sign "L" in FIG. 7 or 8) from the position of collision on the target 103 of the electron beam B (called the "X-ray generating point") to the X-ray window 101*b*. With the structure shown in FIG. 7 or 8, after the electron beam B collides with the target 103, X rays are generated in a direction perpendicular to the optical axis O of the electron beam B. Since the optical axis O and the axis of the target 103 are mechanically arranged perpendicular to each other, a reduction of the above distance L means a reduction in electrode size of the portion of the electron gun 102. Further, since it is necessary to apply potentials independently to the electrodes as noted above, each electrode size inevitably becomes small and its thermal capacity also becomes small.

On the other hand, when minute structures of electronic components and the like are observed with nondestructive inspection system, it is necessary to make also the focus minute in order to obtain clear images. This requires an X-ray tube with a focus diameter in the order of microns or submicrons (called a "microfocus X-ray tube"). In the case of this X-ray tube, it is a necessary condition also to arrange the electrodes of the electron optics in predetermined positions with high precision.

For making the focus of such an X-ray tube minute, it is necessary to make small the opening (see sign "D1" in FIG. 6) of the first electrode 102*b* among the electron gun sizes (dimensions) shown in FIG. 6, with a view to reducing spherical aberration to make the diameter of the crossover small. As a result, the electric field of the second electrode (also called "extractor electrode") 102*c* having a positive potential with respect to the cathode 102*a* has difficulty in reaching the surface of the cathode 102*a* due to the minute size of the opening D1. In order to make the electric field of the second electrode 102*c* reach the surface of the cathode 102*a*, it becomes necessary to minimize the distance (see sign "d1" in FIG. 6) between the cathode 102*a* and first electrode 102*b* so that the cathode 102*a* and first electrode 102*b* are close to each other in the order of sub millimeters. From the same point of view, it is preferable that the thickness of the first electrode (see sign "t1" in FIG. 6) also is made as thin as possible, and it is necessary to reduce also the thickness t1 to the order of submillimeters.

As a result, the surface of the cathode 102*a* controlled to turn on at about 1000° C. is disposed close to the first electrode 102*b*, and the temperature of the first electrode 102*b* which is a thin plate is raised greatly by radiant heat. At this time, the insulator such as alumina joined to the first electrode 102*b*, generally has low heat conduction, and the release of heat (heat radiation) from the thin strut and ribbon electrode 106 is also bad. Thus, predetermined optical dimensions cannot be obtained due to thermal expansion caused by temperature increases of the first electrode and adjacent components. Further, re-radiation from the first electrode to the cathode increases cathode temperature above a set temperature, thereby causing an inconvenience of deteriorating operating life.

However, even if the thermal capacity of each electrode is increased in an attempt to promote heat radiation, restrictions of the electron gun dimensions will be imposed because of the structure in which each electrode size is set small as noted above.

This invention has been made having regard to the state of the art noted above, and its object is to provide an X-ray generating apparatus not easily restricted by structure.

Means for Solving the Problem

To fulfill this object, this invention provides the following construction.

An X-ray generating apparatus of this invention is an X-ray generating apparatus having a housing containing an electron gun and a target, causing an electron beam emitted from the electron gun to collide with the target, and taking X rays generated from a position of collision out through an X-ray window provided on the housing, wherein the electron gun includes a cathode for emitting the electron beam and at least two intermediate electrodes arranged between the cathode and the target, and a potential corresponding to that of the housing is applied to a first electrode of the intermediate electrodes closest to the cathode.

According to the X-ray generating apparatus of this invention, a potential corresponding to that of the housing is applied to the first electrode, closest to the cathode, of at least two intermediate electrodes arranged between the cathode and target. Therefore, even if the first electrode with an increased thermal capacity contacts the housing, the function of the X-ray generating apparatus will never be impaired since the same potential as the potential of the housing is applied to the first electrode. As a result, the first electrode is not easily restricted by structure, so that the first electrode may be enlarged as a measure for heat radiation, or that the first electrode may be placed in contact with the housing.

In one example of the invention noted above, the potentials of the housing and the first electrode are made ground potential. Since the housing essentially is grounded, the same potential as the potential of the housing can be applied to the first electrode by making the potential of the first electrode ground potential. When the potentials of the housing and first electrode are made ground potential, it is possible to make zero or positive potentials the potentials of all the electrodes in the apparatus including the cathode, target and intermediate electrodes noted above. With zero or positive potentials, the potentials of all the electrodes such as the cathode, intermediate electrodes (e.g. a second electrode and a third electrode) and target will have straight polarity with respect to the potential of the first electrode, which facilitates power source control.

In the invention noted above, the first electrode may abut on and directly contact the housing. Alternatively, one or a plurality of conductive members in contact with each other may be arranged between the first electrode and the housing, the conductive member(s) contacting the first electrode and the housing, whereby the first electrode contacts the housing indirectly through the conductive member(s). By making a positive contact in this way, the first electrode and housing are electrically connected when contact is made, whereby the first electrode can be given the same potential as the potential of the housing simply. Further, a positional relationship of the electron gun and housing is determined, to facilitate assembly of the apparatus.

As a preferred example of materials for forming the first electrode, the first electrode is formed of Mo (molybdenum), Ta (tantalum), W (tungsten), Ir (iridium), or a material containing one of these. Molybdenum, tantalum, tungsten, iridium, and materials containing these have low vapor pressures and high melting points. Thus, the gas in the first electrode is hardly released as out gas. As a result, an out gas is not released into the housing, and does not adversely influence the interior of the housing. A high melting point here refers to a melting point at 2000° C. or higher.

As another preferred example of materials for forming the first electrode, the first electrode is formed of stainless steel. In the case of stainless steel, compared with molybdenum and others, the vapor pressure is high and the melting point low at 1500° C. to 1600° C. Although the gas of chromium of stainless steel will, at high temperature, turn into an out gas to be released under ordinary circumstances, the increased thermal capacity of the first electrode inhibits an increase to high temperature, and thus inhibits an out gas release. As a result, an out gas is not released into the housing, and does not adversely influence the interior of the housing. Molybdenum is expensive and difficult to grind, whereas stainless steel is inexpensive and has good processability, thus allowing the size and shape of the first electrode to be set freely. A low melting point here refers to a melting point below 2000° C.

As another low melting point metal, Ti (titanium), Zr (zirconium), Ni (nickel), or an alloy containing one of these, may be used.

Effects of the Invention

According to the X-ray generating apparatus of this invention, a potential corresponding to that of the housing is applied to the first electrode, closest to the cathode, of at least two intermediate electrodes arranged between the cathode and target. Therefore, even if the first electrode with an increased thermal capacity contacts the housing, the function of the X-ray generating apparatus will never be impaired. As a result, the first electrode is not easily restricted by structure, so that the first electrode may be enlarged as a measure for heat radiation, or that the first electrode may be placed in contact with the housing.

The first electrode contacting the housing determines a positional relationship of the electron gun and housing to facilitate assembly of the X-ray generating apparatus. Further, all the potentials of the cathode, intermediate electrodes (e.g. a second electrode and a third electrode) and target will have straight polarity with respect to the potential of the first electrode, which facilitates power source control.

DESCRIPTION OF REFERENCES

1 . . . vacuum housing
1*b* . . . X-ray window
2 . . . electron gun
2*a* . . . cathode
2*b* . . . first electrode
2*c* . . . second electrode
2*d* . . . third electrode
3 . . . target
8 . . . conductive member(s)
T . . . X-ray tube

Embodiments

Figure 1:
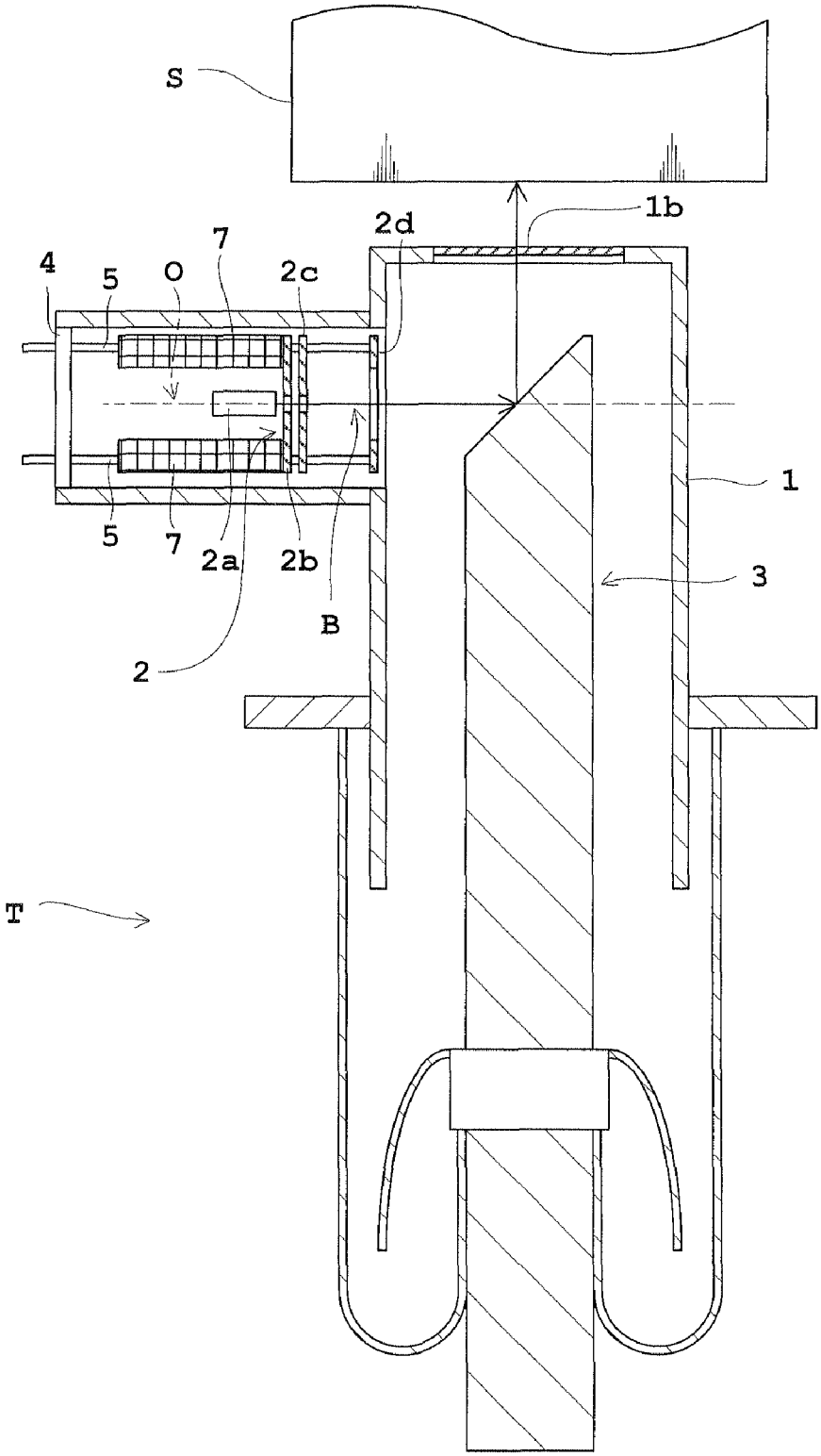
FIG. 1 is a schematic sectional view showing a construction of an X-ray tube according to an embodiment.

An embodiment of this invention will be described hereinafter with reference to the drawings. FIG. 1 is a schematic sectional view showing a construction of an X-ray tube according to the embodiment. This embodiment will be described taking, as an example, a reflection type X-ray tube having an electron gun and a target arranged so that X rays may be emitted in a direction perpendicular to an optical axis of an electron beam, electron beam B colliding with the target to generate X rays. This embodiment will be described taking, as an example, a sealed type X-ray tube with a vacuum-locked housing interior.

As shown in FIG. 1, an X-ray tube T includes a housing 1 containing an electron gun 2 and a target 3, causes the electron beam B emitted from the electron gun 2 to collide with the target 3, and takes X rays generated from a position of collision (X-ray generating point) out through an X-ray window 1*b* provided on the vacuum housing 1. The X-ray tube T corresponds to the X-ray generating apparatus in this invention. The vacuum housing 1 corresponds to the housing in this invention. The electron gun 2 corresponds to the electron gun in this invention. The target 3 corresponds to the target in this invention. The X-ray window 1*b* corresponds to the X-ray window in this invention.

The electron gun 2 includes a cathode 2*a* for emitting the electron beam B, and intermediate electrodes such as a first electrode 102*b*, a second electrode 102*c* and a third electrode 102*d*. These intermediate electrodes are referred to as a first electrode 2*b*, a second electrode 2*c* and a third electrode 2*d* in order from adjacent the cathode 2*a*. The cathode 2*a* corresponds to the cathode in this invention. The first electrode 2*b*, second electrode 2*c* and third electrodes 2*d* correspond to the intermediate electrodes in this invention.

As the cathode 2*a*, a flat cathode similar to that used in a cathode-ray tube is used. This cathode has a long operating life, compared with a filament formed of tungsten. A positive potential is applied to the cathode 2*a*. The second electrode 2*c* is also called "extractor electrode", and in this embodiment, a positive potential is applied to the second electrode 2*c*. The third electrode 2*d* is also called "focusing electrode", and has the function of an electron optical lens for forming a crossover image with a desired focus diameter on the target 3. Zero or positive potential is applied to the third electrode 2*d* according to the desired focus diameter and a distance between the electrodes.

In this embodiment, the first electrode 2*b* is grounded to have the same potential as the vacuum housing 1 which is also grounded. A material for forming the first electrode 2*b*, preferably, is a high melting point metal represented by Mo (molybdenum), Ta (tantalum), W (tungsten), Ir (iridium), or a material containing one of these, or a low melting point material such as stainless steel, Ti (titanium), Zr (zirconium), or various types of alloys other than those of Ti (titanium) and stainless steel.

For applying potentials to the cathode and each electrode, the potentials are applied from outside the X-ray tube T by electrically and mechanically connecting pins 5 of a stem 4 and the objective electrodes through thin struts or ribbon electrodes (not shown). In this embodiment, a first electrode holding member 7 is attached to the pins 5, and this first electrode holding member 7 is placed in contact with or welded to the first electrode 2*b*. The first electrode holding member 7 is formed of a conductive member, and the material for the conductive member is not limited to a particular material. This first electrode holding member 7 can increase the thermal capacity of the first electrode 2*b*.

The structure for increasing the thermal capacity of the first electrode 2*b* is not limited to the first electrode holding member 7 attached to the pins 5, but the first electrode 2*b* itself may be a large structure. The structure may be a disk or cylinder axisymmetrical about an optical axis O.

Although the first electrode holding member 7 does not contact the vacuum housing 1, the first electrode holding member 7 is attached as enlarged to the extent of lying close to the vacuum housing 1 in order to increase the thermal capacity of the first electrode 2*b* as much as possible. Therefore, although it is possible to contact the vacuum housing 1, since the same potential as the potential of the vacuum housing 1 is applied to the first electrode 2*b* from outside the X-ray tube T, there will arise no problem even if it contacts the vacuum housing 1.

With the X-ray tube T according to this embodiment, the same potential as the potential of the vacuum housing 1 is applied to the first electrode 2*b* which is the nearest to the cathode 2*a* among the three intermediate electrodes arranged between the cathode 2*a* and target 3. On the other hand, in this embodiment, the thermal capacity of the first electrode 2*b* is increased by the first electrode holding member 7 placed in contact with or welded to the first electrode 2*b*. Therefore, even if the first electrode 2*b* with the increased thermal capacity contacts the vacuum housing 1, since the same potential as the potential of the vacuum housing 1 is applied to the first electrode 2*b*, the function of the X-ray tube T will never be impaired. As a result, the first electrode 2*b* is not easily restricted by structure, so that the first electrode 2*b* may be enlarged as a measure for heat radiation, or that the first electrode 2*b* may be placed in contact with the vacuum housing 1.

In this embodiment, the potentials of the vacuum housing 1 and first electrode 2*b* are made ground potential. Since the vacuum housing 1 essentially is grounded, the same potential as the potential of the vacuum housing 1 can be applied to the first electrode 2*b* by making the potential of the first electrode 2*b* ground potential. When the potentials of the vacuum housing 1 and first electrode 2*b* are made ground potential, it is possible to make zero or positive potentials the potentials of all the electrodes in the X-ray tube T including the cathode 2*a*, target 3 and intermediate electrodes noted hereinbefore. With zero or positive potentials, the potentials of all the electrodes such as the cathode 2*a*, intermediate electrodes (e.g. the second electrode 2*c* and third electrode 2*d*) and target 3 have straight polarity with respect to the first electrode 2*b*, which facilitates power source control.

Where the first electrode 2*b* is formed of a high melting point metal represented by Mo (molybdenum), Ta (tantalum), W (tungsten), Ir (iridium), or a material containing one of these, since these materials have low vapor pressures and high melting points, the gas in the first electrode 2*b* is hardly released as out gas. As a result, an out gas is not released into the vacuum housing 1, and does not adversely influence the interior of the vacuum housing 1.

Where the first electrode 2*b* is formed of stainless steel, the vapor pressure is high and the melting point low in the case of stainless steel, compared with the high melting point metal represented by molybdenum and others. Although the gas of chromium of stainless steel will, at high temperature, turn into an out gas to be released under ordinary circumstances, the increased thermal capacity of the first electrode 2*b* inhibits an increase to high temperature, and thus inhibits an out gas release. As a result, an out gas is not released into the vacuum housing 1, and does not adversely influence the interior of the vacuum housing 1. Molybdenum is expensive and difficult to grind, whereas stainless steel is inexpensive and has good processability, thus allowing the size and shape of the first electrode 2*b* to be set freely. Other low melting point materials include Ti, Zr, Ni, and an alloy containing one of these.

This invention is not limited to the foregoing embodiment, but may be modified as follows:

(1) The foregoing embodiment has been described taking, as an example, an apparatus for industrial use such as nondestructive inspection system. This invention is applicable also to an apparatus for medical use such as an X-ray diagnostic apparatus.

(2) In the foregoing embodiment, a flat cathode is used as the cathode, but other cathodes may be used.

Figure 2:
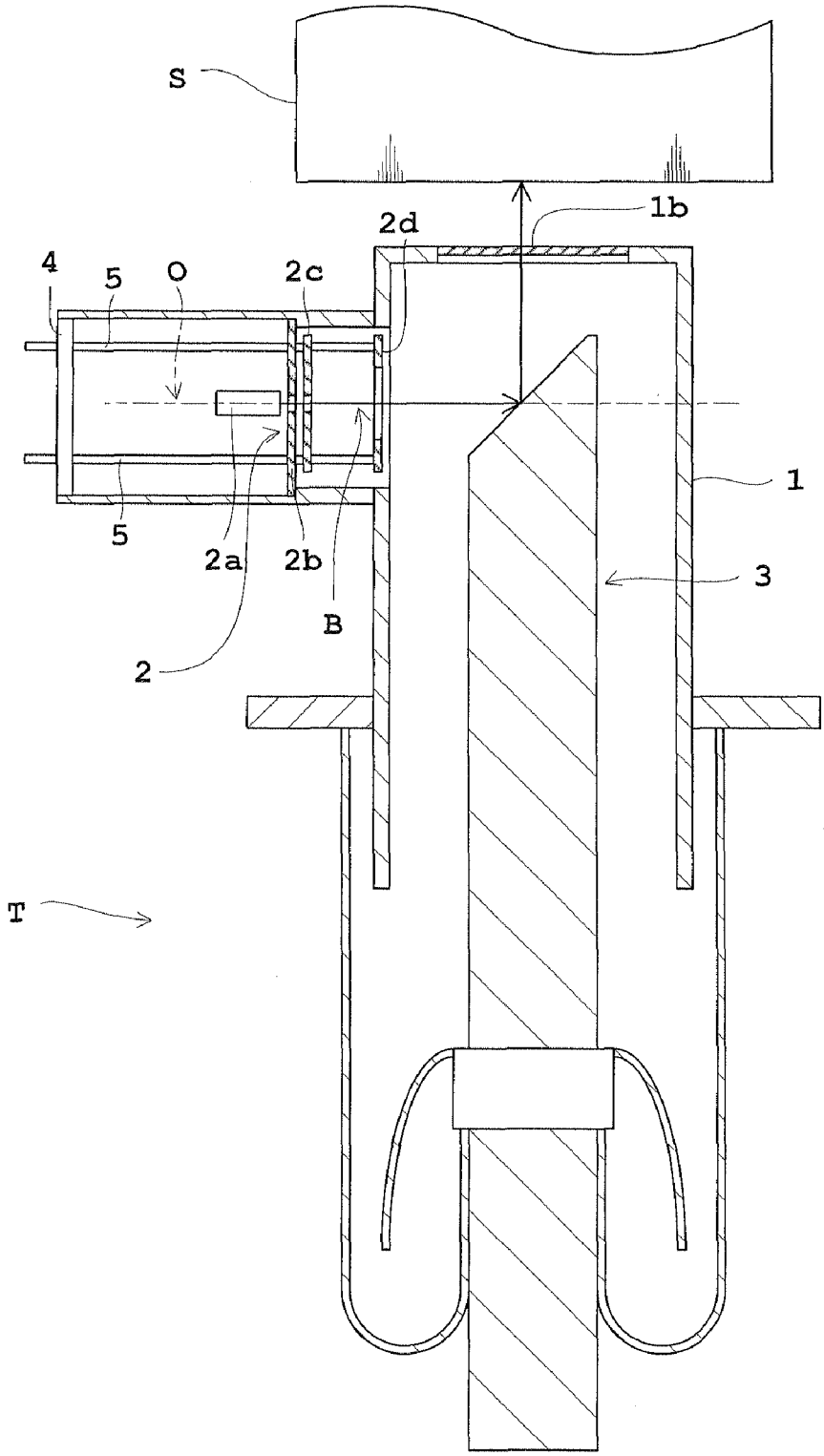
FIG. 2 is a schematic sectional view showing a construction of an X-ray tube according to a modified embodiment.

(3) In the foregoing embodiment, the first electrode holding member 7 is attached as enlarged to the extent of lying close to the vacuum housing 1, and the first electrode 2*a* is not positively placed in contact with the vacuum housing 1. As in the following modifications (4) and (5) as well as this modification (3), the first electrode 2*a* may be positively placed in contact with the vacuum housing 1. As shown in FIG. 2, for example, the first electrode 2*b* abuts on and directly contacts the vacuum housing 1. By making a positive contact in this way, the first electrode 2*b* and vacuum housing 1 are electrically connected when contact is made, whereby the first electrode 2*b* can be given the same potential as the potential of the vacuum housing 1 simply. A positional relationship of the electron gun 2 and vacuum housing 1 also is determined, to facilitate assembly of the X-ray tube T. In this case, it is not necessary to apply a potential to the first electrode 1*b* through the stem 4 and pins 5 from outside the X-ray tube T.

Figure 3:
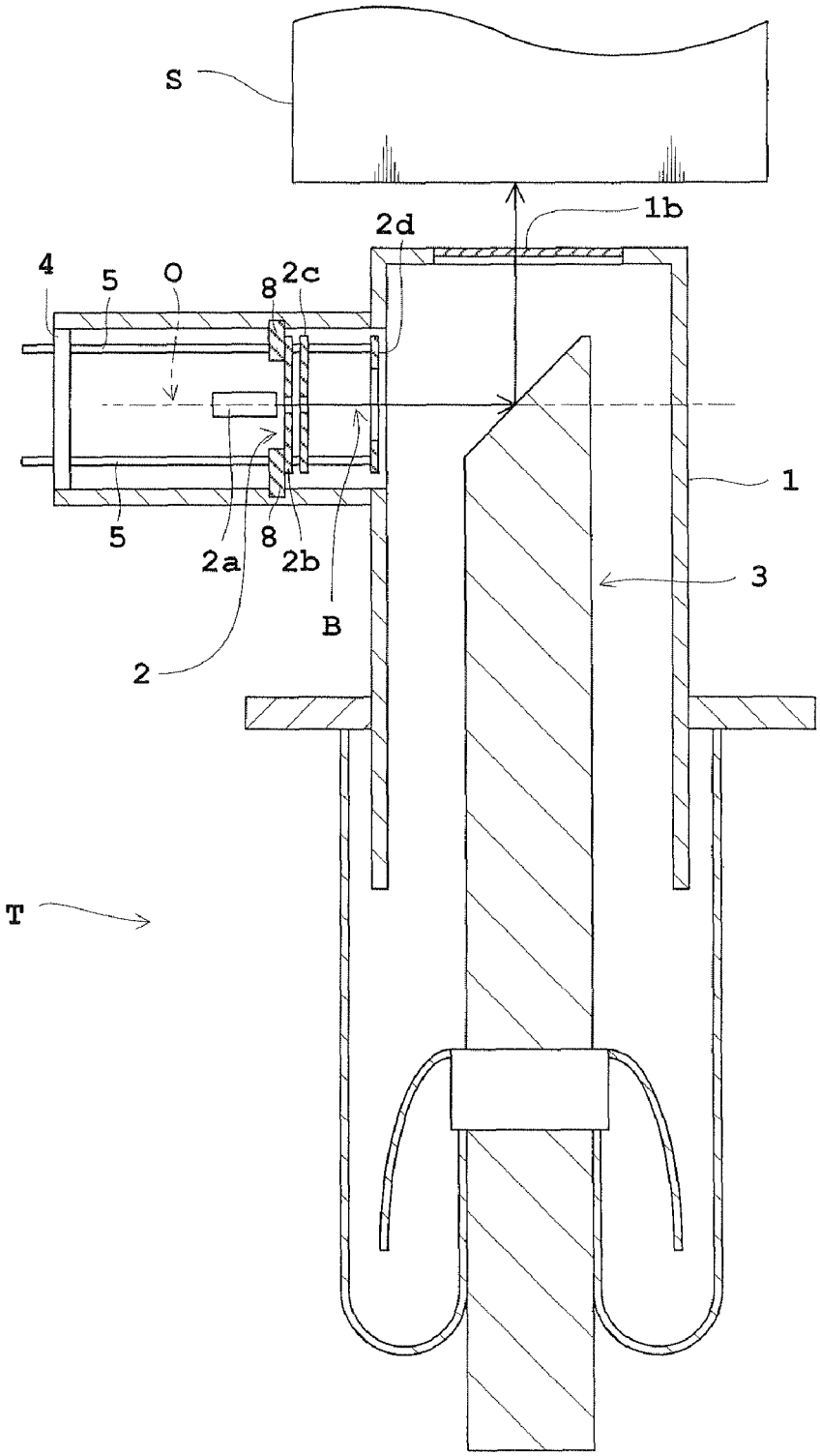
FIG. 3 is a schematic sectional view showing a construction of an X-ray tube according to a further modified embodiment.

(4) In the foregoing embodiment, the first electrode holding member 7 is attached as enlarged to the extent of lying close to the vacuum housing 1, and the first electrode 2*a* is not positively placed in contact with the vacuum housing 1. As in this modification (4) and the following modification (5) as well as the above modification (3), the first electrode 2*a* may be positively placed in contact with the vacuum housing 1. As shown in FIG. 3, for example, a single conductive member 8 may be disposed between the first electrode 2*b* and vacuum housing 1, and the conductive member 8 may be made to contact the first electrode 2*b* and to contact the vacuum housing 1, whereby the first electrode 2*b* contacts the vacuum housing 1 indirectly through the conductive member 8. The conductive member 8 corresponds to the conductive member in this invention. By making a positive contact in this way, the first electrode 2*b* and vacuum housing 1 are electrically connected when contact is made, whereby the first electrode 2*b* can be given the same potential as the potential of the vacuum housing 1 simply. A positional relationship of the electron gun 2 and vacuum housing 1 also is determined, to facilitate assembly of the X-ray tube T. In this case also, it is not necessary to apply a potential to the first electrode 1*b* through the stem 4 and pins 5 from outside the X-ray tube T.

Figure 4:
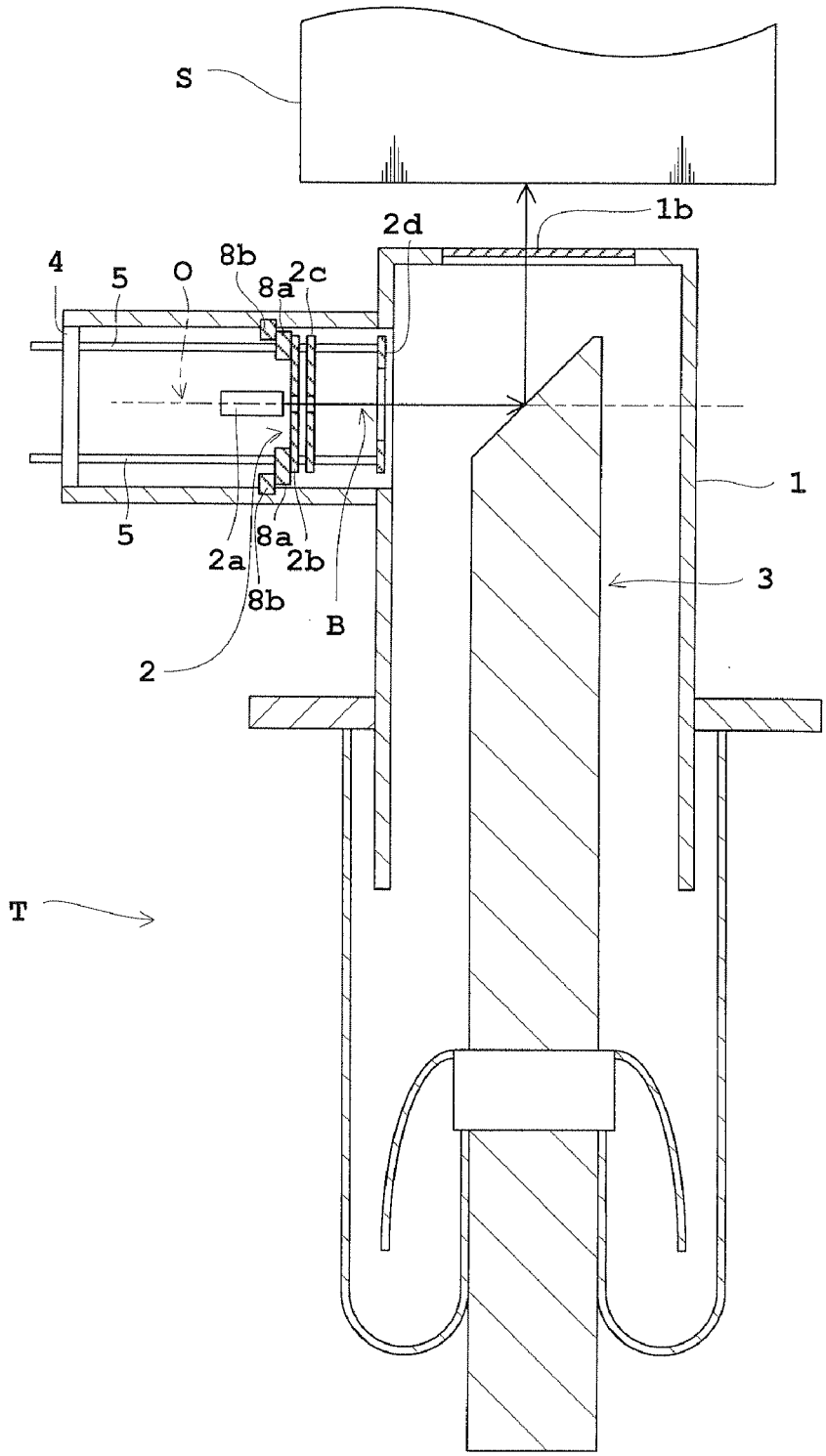
FIG. 4 is a schematic sectional view showing a construction of an X-ray tube according to a further modified embodiment.

(5) In the above modification (4), the single conductive member 8 is disposed between the first electrode 2*b* and vacuum housing 1, and the conductive member 8 is made to contact the first electrode 2*b* and to contact the vacuum housing 1, whereby the first electrode 2*b* contacts the vacuum housing 1 indirectly through the conductive member 8. Instead, a plurality of conductive members in contact with each other may be arranged between the first electrode 2*b* and vacuum housing 1, and the conductive members may be made to contact the first electrode 2*b* and to contact the vacuum housing 1, whereby the first electrode 2*b* contacts the vacuum housing 1 indirectly through the conductive members. As shown in FIG. 4, for example, two conductive members 8*a*, 8*b* in contact with each other are arranged between the first electrode 2*b* and vacuum housing 1, and the conductive member 8*a* is made to contact the first electrode 2*b* while the conductive member 8*b* is made to contact the vacuum housing 1, whereby the first electrode 2*b* contacts the vacuum housing 1 indirectly through the conductive members 8*a*, 8*b*. Three or more conductive members in contact with each other will produce a similar result.

Figure 5:
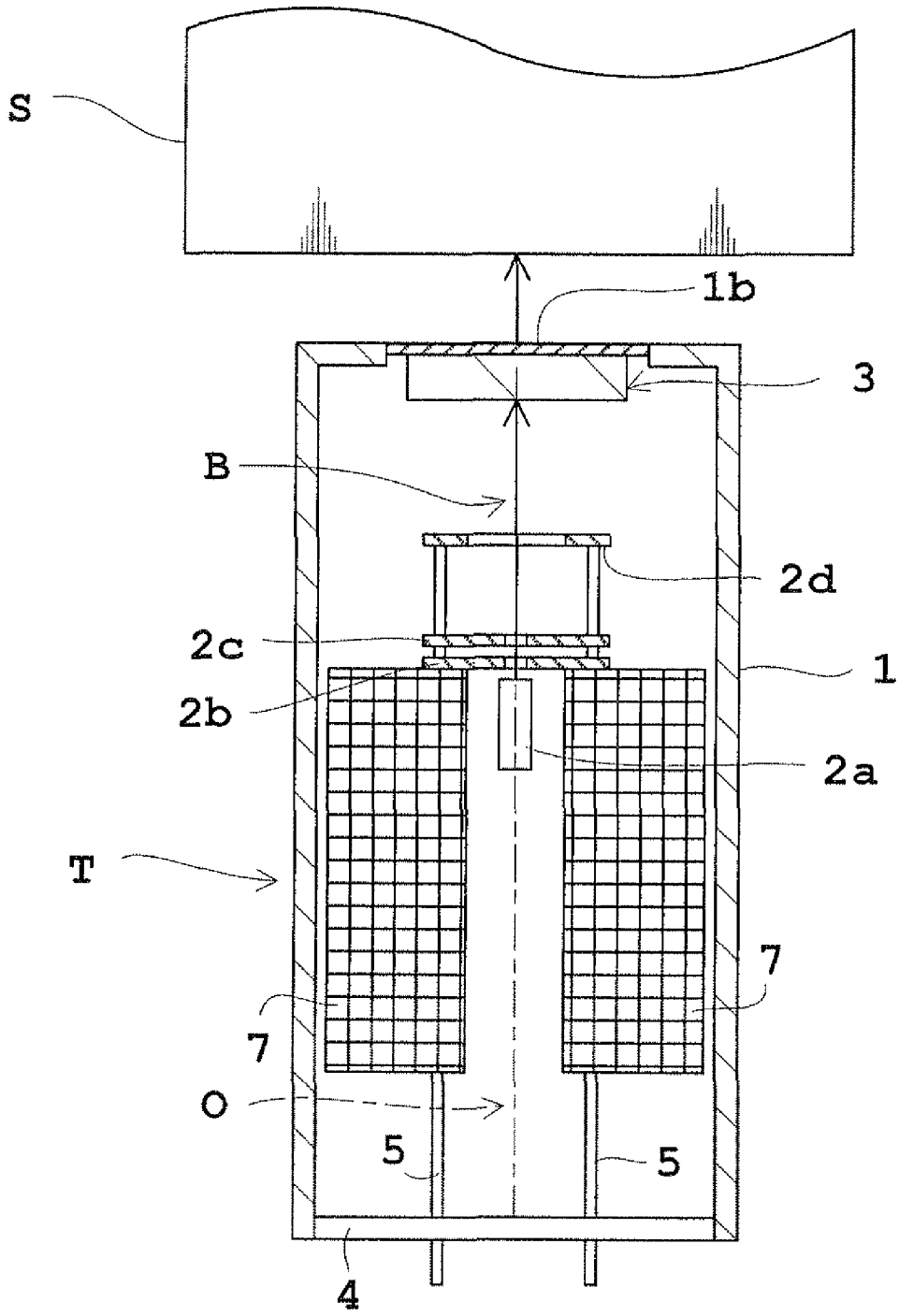
FIG. 5 is a schematic sectional view showing a construction of an X-ray tube according to a further modified embodiment.
Figure 6:
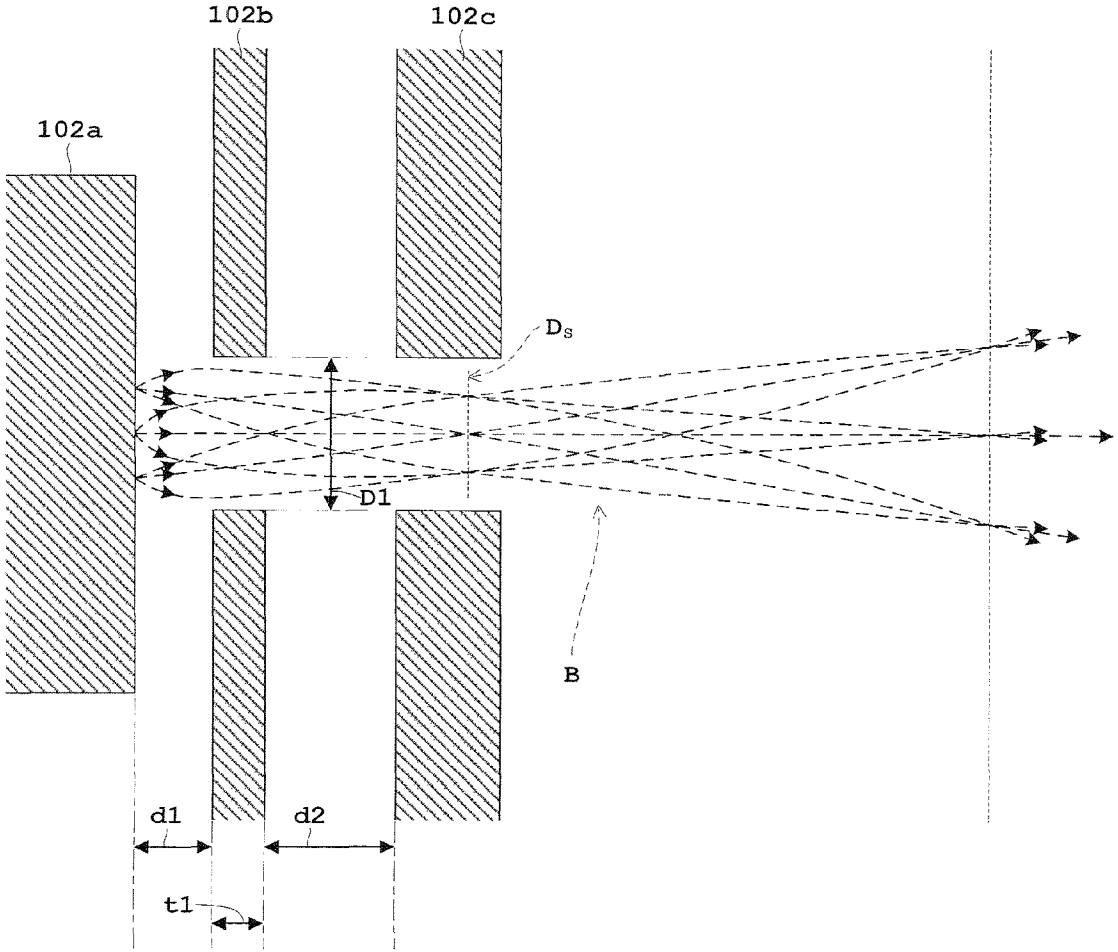
FIG. 6 is a schematic view of a triode (anode, first and second electrodes) of a planar cathode type electron gun.
Figure 7:
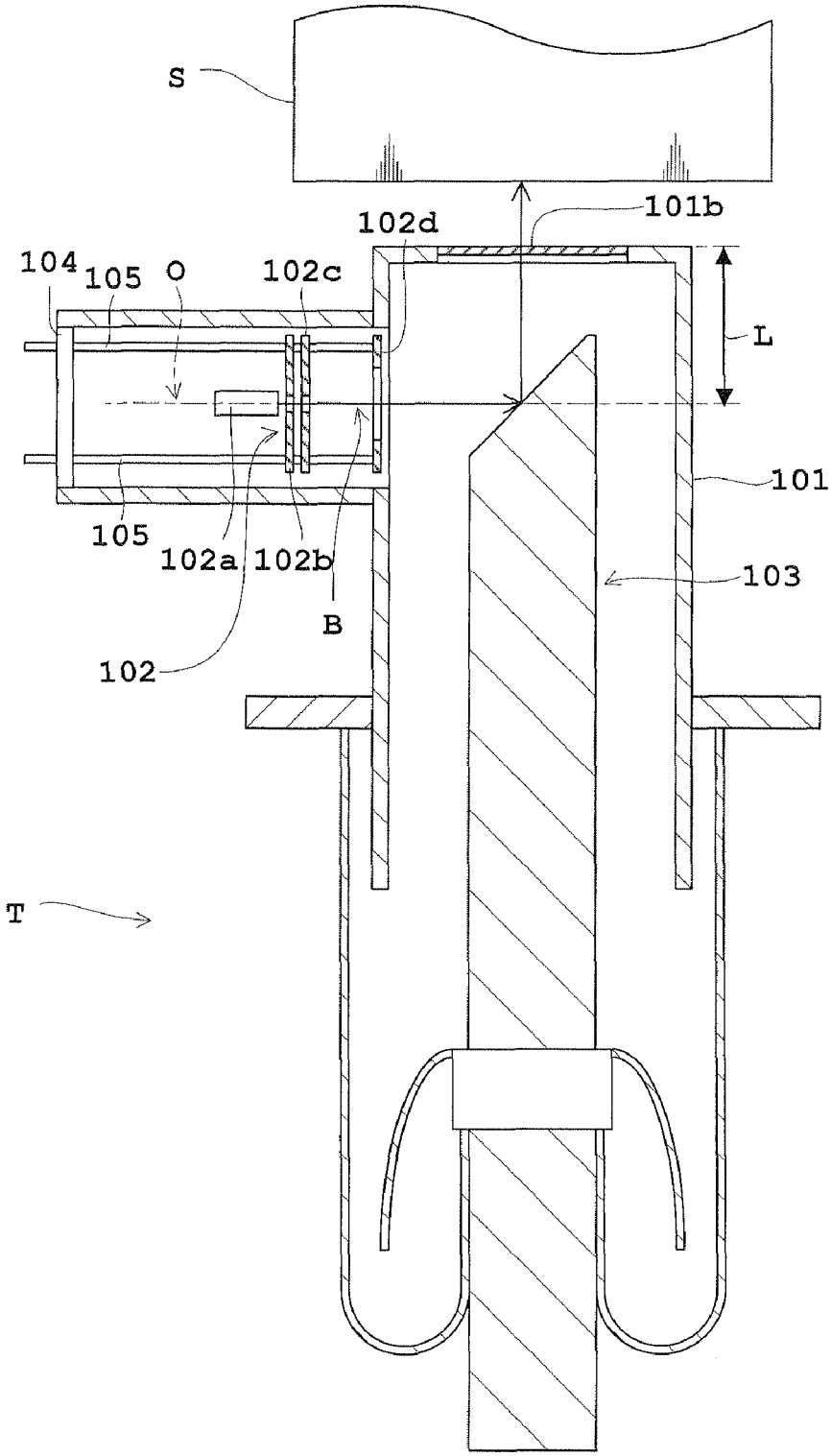
FIG. 7 is a schematic sectional view showing a construction of a conventional X-ray tube.
Figure 8:
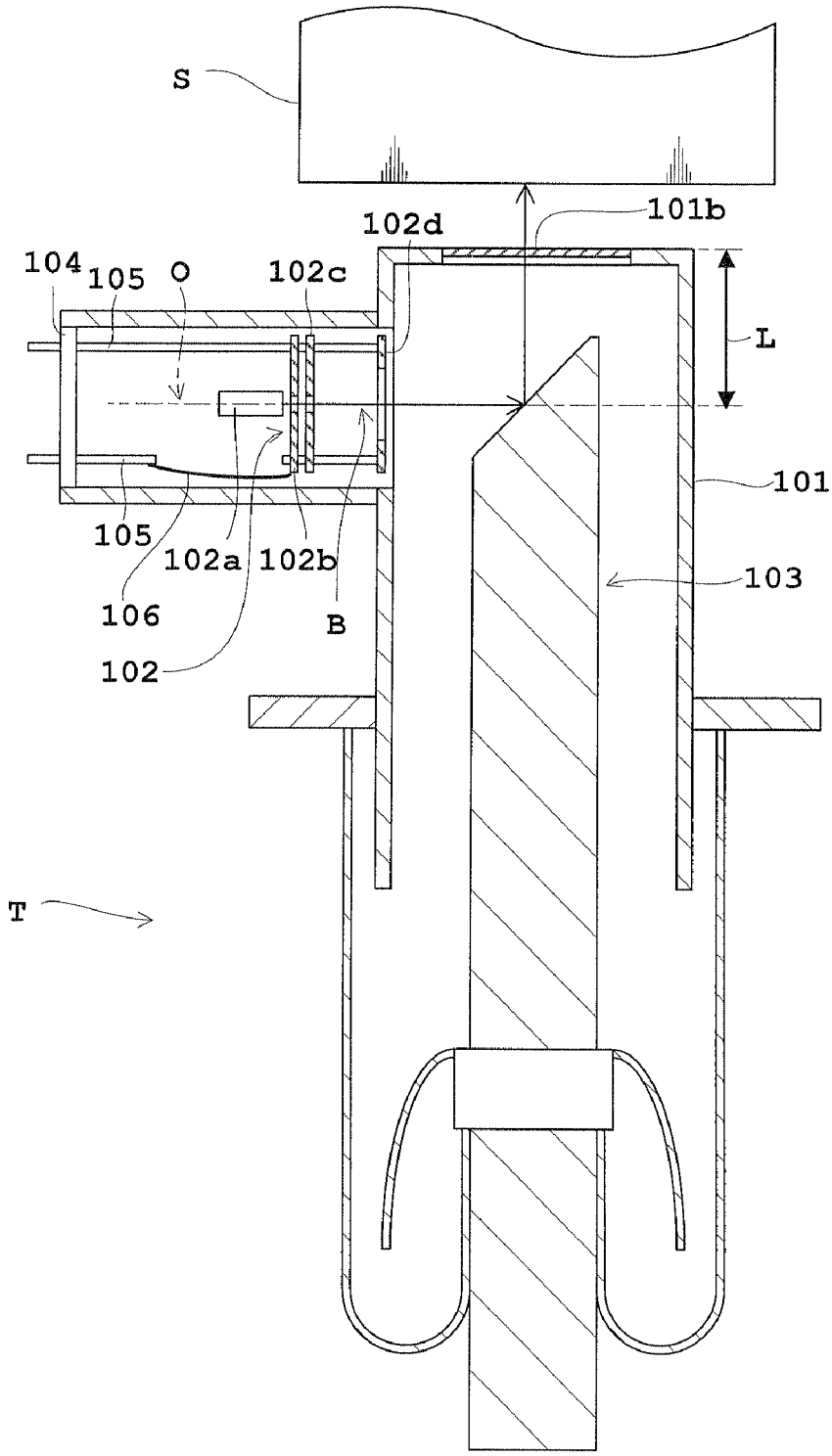
FIG. 8 is a schematic sectional view showing a construction of a conventional X-ray tube.

(6) The foregoing embodiment has been described taking, as an example, a reflection type X-ray tube having an electron gun and a target arranged so that X rays may be emitted in a direction perpendicular to the optical axis of an electron beam, electron beam B colliding with the target to generate X rays. The invention may be applied to a transmission type X-ray tube having an electron gun and a target arranged so that X rays may be emitted parallel to the optical axis of an electron beam, electron beam B colliding with the target to generate X rays. As shown in FIG. 5, for example, the first electrode holding member 7 may be attached as enlarged to the extent of lying close to the vacuum housing 1 as in Embodiment 1. Of course, the transmission type X-ray tube may be combined with the above modifications (3)-(5), to make the first electrode 2*b* positively contact the vacuum housing 1.

(7) In the foregoing embodiment, the vacuum housing 1 is grounded. However, a positive or negative potential may be applied to the vacuum housing 1. In this case, the same positive or negative potential is applied also to the first electrode 2*b*.

(8) As described in connection with the conventional X-ray tube, potential may be applied to the cathode and each electrode through ribbon electrodes.

(9) The foregoing embodiment has been described taking a sealed type X-ray tube as an example. The invention is applicable also to a open type X-ray tube.

(10) The foregoing embodiment provides three intermediate electrodes. The invention is not limited to a particular number of electrodes, but the number of intermediate electrodes may simply be plural. For example, four or more intermediate electrodes may be provided, or only two intermediate electrodes may be provided. Where only two intermediate electrodes are provided, only the first electrode and second electrode may constitute the intermediate electrodes, with the second electrode acting also as the focusing electrode which is the function of the third electrode.

The invention claimed is:

1. An X-ray generating apparatus having a housing containing an electron gun and a target, causing an electron beam emitted from the electron gun to collide with the target, and taking X rays generated from a position of collision out through an X-ray window provided on the housing, wherein the electron gun includes a cathode for emitting the electron beam, at least two intermediate electrodes arranged between the cathode and the target, pins for holding the at least two intermediate electrodes, and a first electrode holding member formed of a conductive member that is in contact with a first electrode of the intermediate electrodes closest to the cathode using the pins, and a potential corresponding to that of the housing is applied to the first electrode, wherein the potentials of the housing and the first electrode are made ground potential, and wherein potentials of all electrodes in the apparatus including the cathode, the target and the intermediate electrodes are zero or positive potential.

2. The X-ray generating apparatus according to claim 1, wherein the first electrode abuts on and directly contacts the housing.

3. The X-ray generating apparatus according to claim 1, comprising one or a plurality of conductive members in contact with each other between the first electrode and the housing, the first electrode contacting the conductive member and the housing, whereby the first electrode contacts the housing indirectly through the conductive member.

4. The X-ray generating apparatus according to claim 1, wherein the first electrode is formed of Mo (molybdenum), Ta (tantalum), W (tungsten), Ir (iridium), or a material containing one of Mo, Ta, W and Ir.

5. The X-ray generating apparatus according to claim 1, wherein the first electrode is formed of stainless steel.

6. The X-ray generating apparatus according to claim 1, wherein the first electrode is formed of a low melting point metal or a material containing the metal.

7. The X-ray generating apparatus according to claim 6, wherein the low melting point metal is Ti (titanium), Zr (zirconium), Ni (nickel), or an alloy containing one of Ti, Zr and Ni.

8. The X-ray generating apparatus according to claim 1, wherein the first electrode is in a structure of a disk or cylinder to increase the thermal capacity of the first electrode.

* * * * *